United States Patent [19]

Garrison et al.

[11] 4,382,467

[45] May 10, 1983

[54] HEAT EXCHANGER OF THE TUBE AND PLATE TYPE

[75] Inventors: Maurice R. Garrison, Hamburg; Victor J. Stachura, East Amherst, both of N.Y.

[73] Assignee: American Precision Industries Inc., Buffalo, N.Y.

[21] Appl. No.: 223,114

[22] Filed: Jan. 7, 1981

Related U.S. Application Data

[63] Continuation of Ser. No. 934,631, Aug. 17, 1978, abandoned.

[51] Int. Cl.[3] ..... F28F 9/22

[52] U.S. Cl. ..... 165/159; 122/510

[58] Field of Search ..... 165/67, 76, 77, 78; 211/16; 122/DIG. 14, 510–512; 138/106

[56] References Cited

U.S. PATENT DOCUMENTS

| | | | |
|---|---|---|---|
| 1,101,969 | 6/1914 | Still | 165/161 |
| 1,338,479 | 4/1920 | Zimmerman | 165/161 |
| 1,617,081 | 2/1927 | Price | 165/78 |
| 1,669,291 | 5/1928 | Dean | 165/161 |
| 1,803,034 | 4/1931 | Potter | 165/160 |
| 2,146,614 | 2/1939 | Bergdoll | 165/179 X |
| 2,183,160 | 12/1939 | Coulter et al. | 165/161 |
| 2,292,750 | 8/1942 | Fields | 165/159 X |
| 2,524,715 | 10/1950 | Rathbun | 165/78 |
| 2,550,725 | 5/1951 | Schultz | 165/161 X |
| 2,843,367 | 7/1958 | Bogus et al. | 165/78 |
| 2,978,226 | 4/1961 | White | 165/161 X |
| 3,271,934 | 9/1966 | Shields | 165/111 |
| 3,532,160 | 10/1970 | Garrison | 165/159 |
| 3,687,193 | 8/1972 | Wright | 165/161 |
| 3,749,160 | 7/1973 | Vestre | 165/160 X |

FOREIGN PATENT DOCUMENTS

| | | | |
|---|---|---|---|
| 1107455 | 3/1968 | United Kingdom | 165/160 |

*Primary Examiner*—William R. Cline
*Assistant Examiner*—Theophil W. Streule, Jr.
*Attorney, Agent, or Firm*—Christel, Bean & Linihan

[57] ABSTRACT

A heat exchanger having an outer shell with an elongated, semi-circular fluid duct plate mounted in the shell. A tube bundle slidable between the duct plate and the shell is fixed at one end relative to the shell. The fluid inlet and outlet configuration, and transverse fluid flow pattern, are typical of those described in U.S. Pat. No. 3,532,160. The exterior of the tube bundle is partially covered with a shrouding to contain the fluid flow within the tube bundle by allowing the fluid to exit only through the outlet side. Sealing mechanisms running longitudinally between the shrouding and the upper duct plate, and between the shrouding and the shell, provide a seal which restricts the fluid flow to a transverse flow through the tube bundle. A seal between the supported end of the tube bundle and the shrouding confines the fluid flow in the bundle and allows for relative expansion of the shrouding and the bundle. Drains are provided in the shell wall on each side of the lower sealing mechanism to allow for moisture run-off from the heat exchanger.

12 Claims, 5 Drawing Figures

Fig. 1.
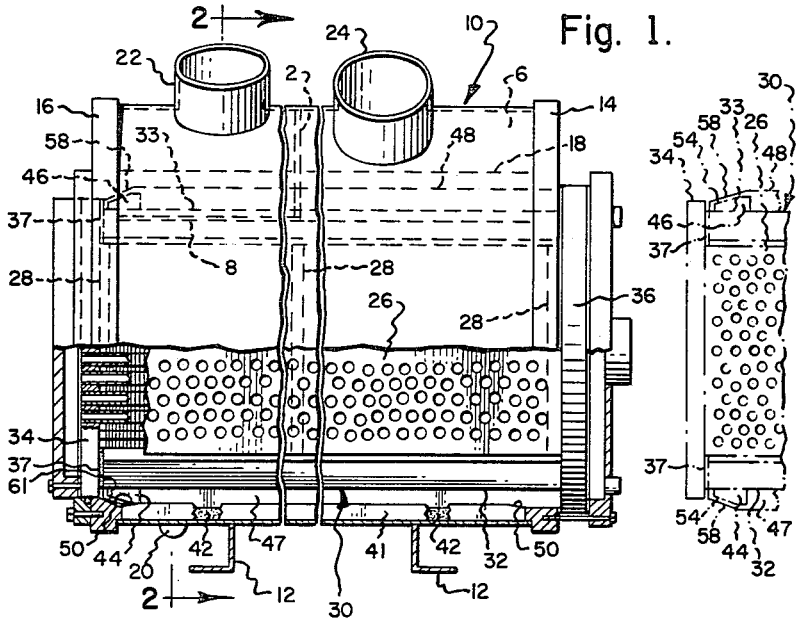
Fig. 5.
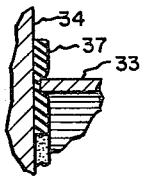
Fig. 2.
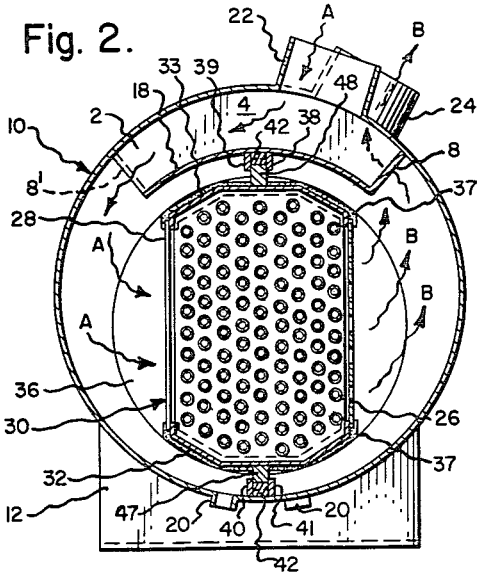
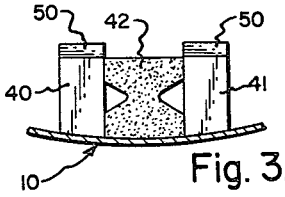
Fig. 3.
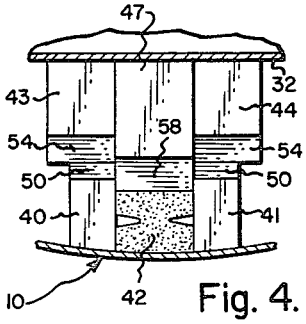
Fig. 4.

HEAT EXCHANGER OF THE TUBE AND PLATE TYPE

This application is a continuation of application Ser. No. 934,631, filed Aug. 17, 1978 now abandoned.

BACKGROUND OF THE INVENTION

This invention relates to heat exchangers and, more particularly, to heat exchangers of the tube and plate type.

Heat exchangers of the type described in U.S. Pat. No. 3,532,160 have been extensively and successfully used and offer many advantages, including high efficiency and the ability to position the inlet and outlet ports at any location lengthwise of the shell within a range equalling approximately half the shell length. This invention retains the advantages of the construction described in the aforesaid patent, and further increases the efficiency of this type of heat exchanger.

SUMMARY OF THE INVENTION

Accordingly, an object of the present invention is to provide an even more efficient heat exchanger of the type generally described in U.S. Pat. No. 3,532,160 wherein the fluid flow is restricted and confined to enter the inlet side of the bundle and flow transversely through the bundle, exiting only through the outlet side thereof.

Another object of the invention is to provide the foregoing in a heat exchanger having protective means to allow for handling of the tube bundle with a minimum of possible damage to the plates and tubes within the bundle.

A further object of the invention is to provide a heat exchanger having means to more easily slide the tube bundle into position within the heat exchanger shell.

Still another object of the invention is to provide the foregoing in a heat exchanger having means to allow relative expansion throughout without allowing any leakage of the restricted and confined fluid flow.

In one form thereof, the heat exchanger of the present invention comprises a cylindrical shell having a duct plate and a tube bundle slidable between said duct plate and shell and mounted within said shell for relative movement therein. The description of the heat exchanger with fluid flow and inlet and outlet configuration found in U.S. Pat. No. 3,532,160 is incorporated by reference in, without necessarily limiting this specification. A shrouding is attached to the tube bundle, protecting the same during bundling and in use confining the fluid flow within the bundle to exit only from the outlet side. Two longitudinally extending sealing mechanisms are provided, one positioned between the shrouding and the duct plate and the other positioned between the shrouding and the shell wall, each comprising in the illustrative embodiment a seal bar attached to the shrouding and fitting between paired runner bars, attached to the shell and to the upper duct plate, to compress a resilient seal positioned between the runner bars, forming an effective barrier to fluid leakage. Guide feet attached to the shrouding adjacent to each seal bar position the latter relative to the running bars and seal elements. The running bars allow for easy positioning of the seal bar and provide support for the leading end of the tube bundle as it is slid into position. A resilient strip between the shrouding and the supported end of the tube bundle allows for expansion of the shrouding, thereby relieving any stress on the tubes within the bundle, and maintains the seal against fluid bypass of the bundle. Drainage outlets are provided for removal of liquid condensed from the fluid as it is cooled to produce a moisture free effluent.

The foregoing and other objects, advantages and characterizing features of the present invention will become clearly apparent from the ensuing detailed description of an illustrative embodiment thereof, taken together with the accompanying drawing wherein like reference numerals denote like parts throughout the various views.

BRIEF DESCRIPTION OF THE DRAWING

FIG. 1 is a side elevational view of a heat exchanger of the present invention with portions broken away and shown partially in section to more clearly illustrate the internal structure thereof, the supported end of the tube bundle prior to assembly being shown in phantom;

FIG. 2 is a transverse sectional view, taken about on line 2—2 of FIG. 1;

FIG. 3 is a fragmentary transverse sectional view, on an enlarged scale, of the shell mounted portion of the flow restricting mechanism;

FIG. 4 is a fragmentary transverse section view of the entire flow restricting mechanism; and FIG. 5 is a fragmentary view in longitudinal section illustrating an expansion detail.

DESCRIPTION OF THE PREFERRED EMBODIMENT

Referring to FIGS. 1 and 2, there is shown a heat exchanger constructed in accordance with the present invention comprising an outer cylindrical shell 10 supported on bracket feet 12 and having end plates 14 and 16 at opposite ends thereof. End plate 16 is beveled forming surface 61 which allows for passage of tube sheet 34 later described herein. An upperfluid duct plate 18 spaced from the shell wall extends substantially the length of shell 10 and is arcuately shaped in cross section. The opposite ends of plate 18 are secured to plates 14 and 16, and a barrier wall 2 parallel to end plates 14 and 16 subdivide the space into inlet and outlet chambers 4 and 6. A first barrier wall 8 extends from wall 2 to end plate 16 on one side of plate 18, and a second barrier wall 8' extends from wall 2 to end plate 14 on the opposite side of plate 18, completing the inlet and outlet chambers. A slidable tube bundle 30 is inserted in spaced relation between the shell 10 and the upper duct plate 18. The flow pattern within the shell 10, briefly described, is characterized by a fluid inlet 22 and a fluid outlet 24, both positioned on the same side of the heat exchanger as the upper duct plate 18. The entering fluid flow A is through the fluid inlet 22 into the inlet side of the shell 10 from which the fluid passes transversely through the tube bundle 30, once and throughout the full length thereof. The exciting fluid flow B leaves the tube bundle 30 through a perforated exiting plate 26, and flows to the fluid outlet 24. The tube bundle 30 positioned in spaced relation within the shell 10 has tubesheets 34 and 36 affixed to opposite ends thereof. Tubesheet 36 is firmly attached to shell 10 and as such is stationary with respect to shell 10. Tubesheet 34 is supported within shell 10 and therefore allows for relative expansion of the tube bundle 30 with respect to shell 10. For a more detailed description of the foregoing construction and operation reference is made to U.S. Pat. No. 3,532,160 the disclosure of which is hereby incorporated herein by reference. Drains 20 are provided in the lower wall of shell 10 to allow for discharge of moisture within the shell 10.

The present invention confines the fluid flowing transversely within the bundle 30 to exit only through the perforated plate 26. In the illustrated embodiment, this is accomplished by a shrouding 32 and 33, externally placed around the tube bundle 30, extending the full length of the bundle and completely enclosing the bundle between the inlet and outlet sides thereof. The shrouding 32 and 33 is fastened in place about the bundle 30 by a series of three tie bars 28 which extend across the inlet side of the tube bundle centrally and adjacent the opposite ends thereof and by plate 26, all welded thereto. The shrouding is made of a non-porous material, typically metal which provides an effective seal against fluid leakage. Thereto, once fluid has entered the bundle from the inlet side it is confined to the bundle until it exits from the outlet side.

The invention further comprises a means for restricting the transverse fluid flow A to flow only through the bundle 30, preventing any bypassing of the bundle. In the illustrated embodiment this is accomplished by an arrangement including a first pair of runner bars 40 and 41 attached to the shell wall. Another pair of runner bars 38 and 39 are attached to the upper duct plate 18 on the side facing the tube bundle 30. Both pairs of runner bars have a resilient, compressible element 42 therebetween which is V-notched in its sides and when compressed, acts as an effective sealant against fluid flow. Other types of seal elements, including metallic seals, can be used with this invention. The runner bars all extend longitudinally the length of the shell, and are bevelled at each end of the shell providing surfaces 50. The runner bar at the supported end of the tube bundle is bevelled to allow for easy removal of the tube bundle by preventing possible catching of the tubesheet 34 on the end plate 16. The stationary end is bevelled to allow for easy positioning and sliding of the tube bundle 30 during assembly. A pair of seal bars 47 and 48 are welded to the shrouding 32 and 33 respectively. Seal bars 47 and 48 extend the length of the bundle 30 and serve to compress the resilient elements 42 between the respective runner bars. Each seal bar is bevelled at its leading and creating surfaces 58 which engage seal elements 42 upon inserting the tube bundle in the shell, and facilitate sliding of the tube bundle 30 within the shell 10 without tearing the seal elements.

Guiding and positioning means further help in the positioning of the tube bundle 30 in the shell. The means shown comprise a pair of guide feet at the leading ends of seal bars 47 and 48, respectively, one such pair of guide feet, 43 and 44 being shown in FIG. 4. One of the other pair is shown at 46 in FIG. 1, the otherof that pair not shown but being the inverted counterpart of 43 and identical to 46 but on the opposite side of bar 48. The guide feet also are bevelled, creating surfaces 54 on each which engage runner bar surfaces 50. The guide feet are attached to the shrouding 32 and 33 respectively, and are found adjacent to, and on opposite sides of, their respective seal bar. The guide feet engage and ride on the outer edge surfaces of the runner bars and have the essential purpose of allowing the seal bars to compress the respective resilient elements 42 only a limited extent, sufficient to provide a fluid tight seal between elements 42 and seal bars 47, 48, by limiting the depth of insertion of seal bars 47, 48 between the respective pairs of runner bars. In the illustrated embodiment, elements 42 are compressed only to a height equal to the height of the respective runner bar plus the guide feet height minus the height of the respective seal bar. This then limits compression of the elements 42 to be compressed within their elastic limits and allows the seal bars 47 and 48 to slide smoothly along the resilient elements 42. The V-notched sides of elements 42 accommodate the compression of the seal elements.

Finally, referring to FIGS. 1, 2 and 5, the invention incorporates a resilient element 37 which is fitted between said shrouding 32 and 33 and the supported tubesheet 34 of the tube bundle 30. This allows for expansion of the shrouding 32 and 33 relative to the tube bundle without application of significant stress upon the tubes within the tube bundle 30. This resilient element 37, typically rubber, also has the added advantage of simultaneously providing a leak proof seal against the escape of fluid from the bundle 30.

In operation, the flow restricting means is engaged and made operable upon sliding the seal bars 47 and 48 between and along the respective runner bars 40, 41 and 38, 39, thereby compressing the resilient element 42 therebetween. Seal bars 47 and 48 are guided by the respective guide feet which contact and slide upon the respective runner bars, positioning the seal bars in proper relation to the seal elements 42. Coacting surfaces 50 and 54 facilitate engagement of guide feet and the respective runner bars, and relative sliding movement therebetween, and surface 58 facilitates relative sliding between seal bars 47, 48 and seal elements 42 without tearing the latter. During heat exchange operation, the fluid A entering the shell can only enter the tube bundle 30 on the inlet side and is effectively prevented from leaking around the bundle 30 by the restricting means comprising the seal bars, runners and elements 42. Once inside the bundle, the fluid flow can only exit through the perforated plate 26 because of the non-porous shrouding 32 and 33 covering the rest of the tube bundle 30. Therefore, all of the fluid is constrained to pass transversely completely through the tube bundle. As the tube bundle 30 becomes warmer the differing expansion coefficients between the shrouding 32, 33 and the tubes is compensated for by the resilient element 37 placed between the shrouding 32, 33 and the tube bundle 30 tubesheet 34.

Another feature of this invention is that the shrouding 32, 33, in addition to confining fluid flow within the bundle, covers and protects the tube bundle during handling prior to being fitted within the shell.

From the foregoing, it is apparent that the objects of the present improvement have been fully accomplished. As a result of the present improvement a new and improved heat exchanger of increased efficiency is provided. A preferred embodiment of the principles of this invention having been described and illustrated, it is to be realized that the same are not limited to the particular heat exchanger configuration shown in the drawing, and that modifications thereof are contemplated and can be made without departing from the broad spirit and scope of this invention as defined in the appended claims.

What is claimed is:

1. In a heat exchanger of the type comprising a shell having a fluid inlet and a fluid outlet, a tube bundle longitudinally positioned in a spaced relation to said shell, and means directing fluid flow transversely through said tube bundle from an inlet side to an outlet side thereof, the improvement comprising:

a. means for restricting the transverse fluid flow to a flow only through said bundle; and b. means for confining said transverse fluid flow within said bundle to exit only through said outlet side thereof.

2. A heat exchanger as defined in claim 1, said means directing fluid flow including an upper fluid duct plate mounted longitudinally within said shell in spaced relation to said tube bundle and said inner shell wall, said fluid inlet and outlet being on the same side of said shell as said duct plate, and said runner bars being connected to said duct plate.

3. A heat exchanger as defined in claim 1, said runner bars being connected to said inner shell wall.

4. A heat exchanger as defined in claim 2, said restricting means including a second pair of runner bars longitudinally extending along an inner shell wall portion opposite said duct plate and connected to said shell wall portion and having a second resilient element therebetween, a second seal bar longitudinally extending along said tube bundle, and second guide means in contact with a second runner bar to position said second seal bar in sealing relation to said second resilient element, said restricting means being positioned between the inlet and outlet sides of said bundle in generally opposed relation.

5. A heat exchanger as defined in claim 2, said guide means comprising guide feet adjacent to and on either side of said seal bar, said guide feet contacting said runner bars and allowing said seal bar to compress said resilient element only a limited extent.

6. A heat exchanger as defined in claim 1 with means allowing expansion of said shrouding relative to said bundle.

7. A heat exchanger as defined in claim 2, a second pair of runner bars longitudinally extending along an inner shell wall portion opposite said duct plate and connected to said shell wall portion, a second resilient element between said second runner bars, a second seal bar longitudinally extending along said tube bundle, guide feet adjacent each seal bar and contacting said runner bars to limit the compression of said resilient elements by said seal bars, said restricting means being positioned between the inlet and outlet sides of said bundle in generally opposed relation, and a shrouding covering the exterior of said bundle between the inlet and outlet sides thereof to confine fluid flow therein.

8. In a heat exchanger of the type comprising a shell having a fluid inlet to said shell and a fluid outlet from said shell, a tube bundle extending longitudinally within said shell along a first axis, said tube bundle being positioned in spaced relation to said shell to provide a fluid inlet to said bundle on one side only thereof and a fluid outlet from said bundle on the opposite side only thereof, and means for directing the flow of fluid from said shell inlet only to said inlet side of said bundle and transversely through said bundle in a direction generally normal to said first axis once and in one direction only to said outlet side of said bundle and then from said outlet side of said bundle only to said shell outlet, said inlet and outlet sides of said bundle extending longitudinally substantially the full length thereof, the improvement comprising:

(a) means for restricting transverse fluid flow to flow only through said bundle; and (b) means for confining the transverse fluid flow within the bundle to exit only through said outlet side, said last-named means comprising shrouding partially covering the exterior of said bundle, said shrouding extending longitudinally of said bundle substantially the full length thereof, and also extending from said inlet side of said bundle to said outlet side thereof to enclose said bundle between said sides while leaving said sides open for the entrance and exiting, respectively, of fluid passing transversely through said bundle in heat exchange relation therewith;

(c) wherein said shrouding is positioned on opposite sides of said bundle between said inlet and outlet sides thereof, said shell outlet being positioned on the same side of said shell as said shell inlet and both said shell inlet and said shell outlet being positioned generally on the same side of said shell as one of the shrouded sides of said bundle, said flow directing means including barrier wall means carried by said shell between said shell inlet and outlet and said one shrouded side of said bundle, said one shrouded side being spaced from said flow directing means; said flow restricting means including sealing means extending between said one shrouded side and said flow directing means and other sealing means extending between said shell and the other shrouded side of said bundle, said flow restricting means preventing bypassing of said bundle from said inlet side to said outlet side thereof;

9. A heat exchanger as set forth in claim 8, together with tie rod means extending between said shrouding to fasten said shrouding in place about said bundle.

10. A heat exchanger as set forth in claim 8, wherein said tube bundle is of the tube and plate type.

11. A heat exchanger as set forth in claim 8, wherein said other sealing means includes a resilient seal under compression, together with means supporting said bundle in spaced relation to said shell in a manner limiting compression of said resilient seal.

12. In a heat exchanger of the type comprising a shell having a fluid inlet to said shell and a fluid outlet from said shell, a tube bundle extending longitudinally within said shell along a first axis, said tube bundle being positioned in spaced relation to said shell to provide a fluid inlet to said bundle on one side only thereof and a fluid outlet from said bundle on the opposite side only thereof, and means for directing the flow of fluid from said shell inlet only to said inlet side of said bundle and transversely through said bundle in a direction generally normal to said first axis only once and in one direction only to said outlet of said bundle and then from said outlet side of said bundle only to said shell outlet, said shell outlet being positioned on the same side of said shell as said shell inlet and both said shell inlet and said shell outlet being positioned generally between said inlet and outlet shell outlet sides of said bundle, the improvement comprising:

(a) means for restricting the transverse fluid flow to a flow only through said bundle, said last-named means comprising sealing means between said bundle and said shell on opposite sides of said bundle extending longitudinally of said bundle, said sealing means being located between the inlet and outlet sides of said bundle; and (b) means for confining said transverse fluid flow within said bundle to exit only through said outlet side thereof.

* * * * *

UNITED STATES PATENT AND TRADEMARK OFFICE

CERTIFICATE OF CORRECTION

PATENT NO. : 4,382,467

DATED : May 10, 1983

INVENTOR(S) : Maurice R. Garrison and Victor J. Stachura

It is certified that error appears in the above-identified patent and that said Letters Patent are hereby corrected as shown below:

Claim 12, column 6, line 51, after "outlet" insert -- side --.

Signed and Sealed this

Second Day of August 1983

[SEAL]

Attest:

GERALD J. MOSSINGHOFF

Attesting Officer

Commissioner of Patents and Trademarks

UNITED STATES PATENT AND TRADEMARK OFFICE

CERTIFICATE OF CORRECTION

PATENT NO. : 4,382,467

DATED : May 10, 1983

INVENTOR(S) : Maurice R. Garrison and Victor J. Stachura

It is certified that error appears in the above-identified patent and that said Letters Patent are hereby corrected as shown below:

Column 2, line 57, change "exciting" to -- exiting --.

Column 3, line 17, change "Thereto" to -- Therefore --.

Column 3, line 54, change "otherof" to -- other of --.

Claim 1, column 5, line 2 delete "and".

Claim 1, column 5, line 5, after "thereof" insert:

-- ; and c) said means for restricting said transverse flow within said shell comprising a pair of runner bars, longitudinally extending along an inner shell wall with a resilient element therebetween, a seal bar longitudinally extending along said tube bundle, and guide means adjacent to said seal bar, whereby said seal bar fits between said runner bars thereby compressing said resilient element, and said guide means contact a runner bar to position said seal bar in sealing relation to said resilient element --.

UNITED STATES PATENT AND TRADEMARK OFFICE

CERTIFICATE OF CORRECTION

PATENT NO. : 4,382,467

DATED : May 10, 1983

INVENTOR(S) : Maurice R. Garrison and Victor J. Stachura

It is certified that error appears in the above-identified patent and that said Letters Patent are hereby corrected as shown below:

Claim 6, column 5, line 32 change "1" to -- 8 --.

Claim 8, column 6, line 29 change ";" to -- . --.

Signed and Sealed this

*Third* Day of *July 1984*

[SEAL]

*Attest:*

GERALD J. MOSSINGHOFF

*Attesting Officer*

*Commissioner of Patents and Trademarks*